US007963227B1

(12) United States Patent
Brunn

(10) Patent No.: US 7,963,227 B1
(45) Date of Patent: Jun. 21, 2011

(54) MULTIPLE REPORT STUN GRENADE

(75) Inventor: Michael Brunn, Sea Cliff, NY (US)

(73) Assignee: CombMed Systems, Inc., Great Neck, NY (US)

( * ) Notice: Subject to any disclaimer, the term of this patent is extended or adjusted under 35 U.S.C. 154(b) by 159 days.

(21) Appl. No.: 12/319,236

(22) Filed: Jan. 5, 2009

(51) Int. Cl.
*F42B 8/00* (2006.01)

(52) U.S. Cl. ..... 102/498; 102/482; 102/360

(58) Field of Classification Search ..... 102/355, 102/360, 498, 502, 529, 482
See application file for complete search history.

(56) References Cited

U.S. PATENT DOCUMENTS

| | | | | |
|---|---|---|---|---|
| 4,932,328 | A * | 6/1990 | Pinkney et al. | 102/482 |
| 4,947,753 | A * | 8/1990 | Nixon, III | 102/487 |
| 5,085,147 | A * | 2/1992 | Gold et al. | 102/486 |
| 5,654,523 | A | 8/1997 | Brunn | |
| 6,595,139 | B1 * | 7/2003 | Haeselich | 102/498 |
| 7,387,073 | B2 * | 6/2008 | Bodley et al. | 102/498 |
| 7,721,651 | B2 * | 5/2010 | Lubbers et al. | 102/498 |
| 2006/0081147 | A1 * | 4/2006 | Walsh | 102/368 |

FOREIGN PATENT DOCUMENTS

| | | | |
|---|---|---|---|
| WO | WO 9408200 | A1 * | 4/1994 |
| WO | WO 2006063564 | A1 * | 6/2006 |

OTHER PUBLICATIONS

Machine Translation of W02006063564. <http://epo.worldlingo.com/wl/epo/epo.html?ACTION=description-retrieval&OPS=ops.epo.org&LOCALE=en_GB&FORMAT=docdb&COUNTRY=WO&NUMBER=2006063564&KIND=A1&T=1> performed Jul. 2010.*

Machine Translation of W09408200. <http://epo.worldlingo.com/wl/epo/epo.html?ACTION=description-retrieval&OPS=ops.epo.org&LOCALE=en_GB&FORMAT=docdb&COUNTRY=WO&NUMBER=9408200&KIND=A1&T=1> performed Jul. 2010.*

* cited by examiner

*Primary Examiner* — Gabiel J Klein
(74) *Attorney, Agent, or Firm* — Bennet K. Langlotz; Langlotz Patent & Trademark Works, Inc.

(57) ABSTRACT

The present invention overcomes the limitations of the prior art by providing a stun grenade device with an elongated cylindrical body having a cylindrical sidewall and opposed top and bottom end faces. The body includes a delay chamber containing a delay material, and has a number of flash charge chambers each containing a quantity of flash charge material. The body defines a number of ignition passages, each communicating from a respective flash charge chamber to the delay chamber. Each flash charge chamber has at least one exhaust aperture penetrating the top or bottom end face. Each flash charge chamber may be formed in an elongated tubular sleeve inset in a frame of a different material.

42 Claims, 8 Drawing Sheets

MULTIPLE REPORT STUN GRENADE

FIELD OF THE INVENTION

This invention relates to stun grenades employed by law enforcement and military as distraction devices.

BACKGROUND AND SUMMARY OF THE INVENTION

Stun grenades, or "flash-bang" devices are used by military and law enforcement as non-lethal devices intended to distract or stun dangerous suspects or adversaries. Such devices are deployed to minimize hostile responses, and to generate compliance.

A typical existing device employs a "single bang" provided by a quantity of flash-charge material (such as a mixture of aluminum powder and potassium perchlorate) that is detonated after a brief delay. A fuse is activated by release of a handle as in a typical grenade, and the fuse ignites a column of delay material (such as black powder or Zirconium Nickel). The column provides a delay (typically ½ second) until the flame front in the delay material reaches an aperture that communicates with the flash-charge material, igniting it to provide a bright flash and loud report.

One such device is shown in U.S. Pat. No. 5,654,523 to Brunn, titled "Stun Grenade." This "single-bang" device has an advantageous configuration. Like many others, it is a cylindrical body sized to readily be gripped by an adult hand, so that the device is secure in the user's fist, with the ends of the cylinder protruding beyond each end of the user's fist. The disclosed device has the advantage that all the vent holes for releasing the energy of the flash charge material come out the ends of the grenade body. While a device normally discharges only after a delay following release by the user, there is a remote possibility that the grenade may discharge while still in the user's hand, such as if the user is distracted, or the device snags on the user's glove. The disclosed device minimizes the risk of serious injury in such an event by discharging the combustion gases out the ends of the device, with no apertures in the cylindrical sidewall of the device.

Other devices have sought to provide added tactical effectiveness by employing a device with multiple reports in a single grenade. Such a device is the 9-Bang grenade produced by Nico-Pyrotechnik of Düsseldorf, Germany. This is a cylindrical body with a similar form to the Brunn device. It is a solid steel or aluminum body with a central axial delay column. The cylindrical sidewall of the body is bored with nine chambers, each providing a cup that opens radially outward, giving the body the approximate appearance of a cylindrical piece of "Swiss cheese." Each cup is filled with flash charge material and has a different position along the length of the body. A small hole is bored from the floor of each cup to the central delay column, with each hole at a different position along the length of the column. This provides for the charges in each cup discharging in sequence as the flame proceeds down the delay column. Accordingly, a useful sequence of many bangs (and flashes) is generated upon discharge of the device, simulating repeated gunfire instead of a single loud report.

The Nico device suffers the disadvantage of having the flash charge materials projecting their discharge energy exactly where a user's hand grips the device, risking serious injury in the event of a discharge while the device is still being held.

Accordingly, there is a need for a multiple-report stun grenade device that provides safe function even in the event of unexpected discharge while in a user's hand.

The present invention overcomes the limitations of the prior art by providing a stun grenade device with an elongated cylindrical body having a cylindrical sidewall and opposed top and bottom end faces. The body includes a delay chamber containing a delay material, and has a number of flash charge chambers each containing a quantity of flash charge material. The body defines a number of ignition passages, each communicating from a respective flash charge chamber to the delay chamber. Each flash charge chamber has at least one exhaust aperture penetrating the top or bottom end face. Each flash charge chamber may be formed in an elongated tubular sleeve inset in a frame of a different material.

DETAILED DESCRIPTION OF A PREFERRED EMBODIMENT

Figure 1:
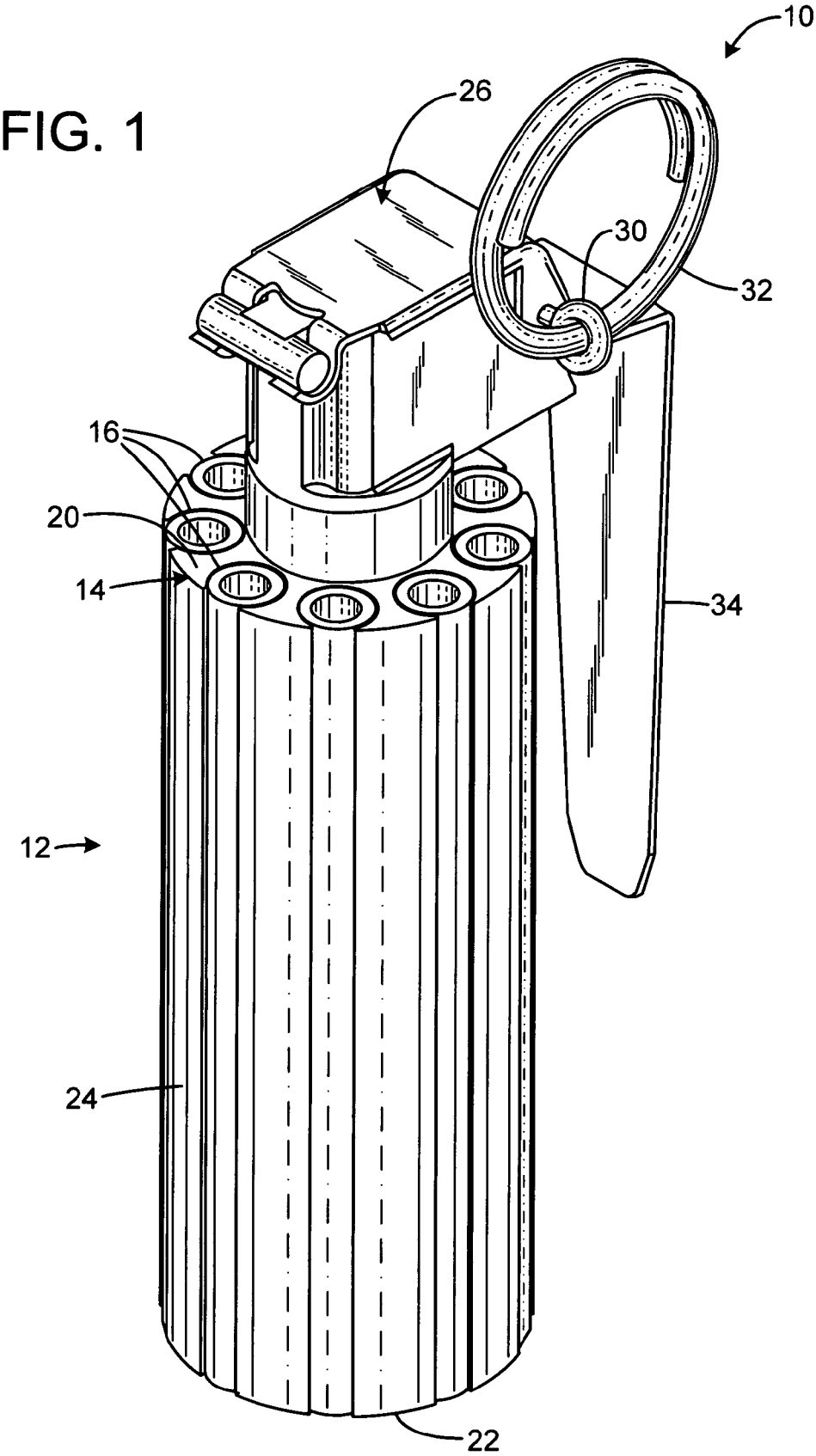
FIG. 1 is a perspective view of a device according to a preferred embodiment of the invention.

FIG. 1 shows a flash-bang pyrotechnic device 10 having a cylindrical body 12 formed of a cylindrical frame 14 holding nine sleeves 16. The body has a top end face 20, a bottom end face 22, and a cylindrical sidewall 24. A fuse assembly 26 protrudes from the top end face and includes a safety pin 30 with connected extraction ring 32 and a spring-loaded paddle 34 that initiates a discharge sequence when the paddle is released after the safety pin is removed.

Figure 2:
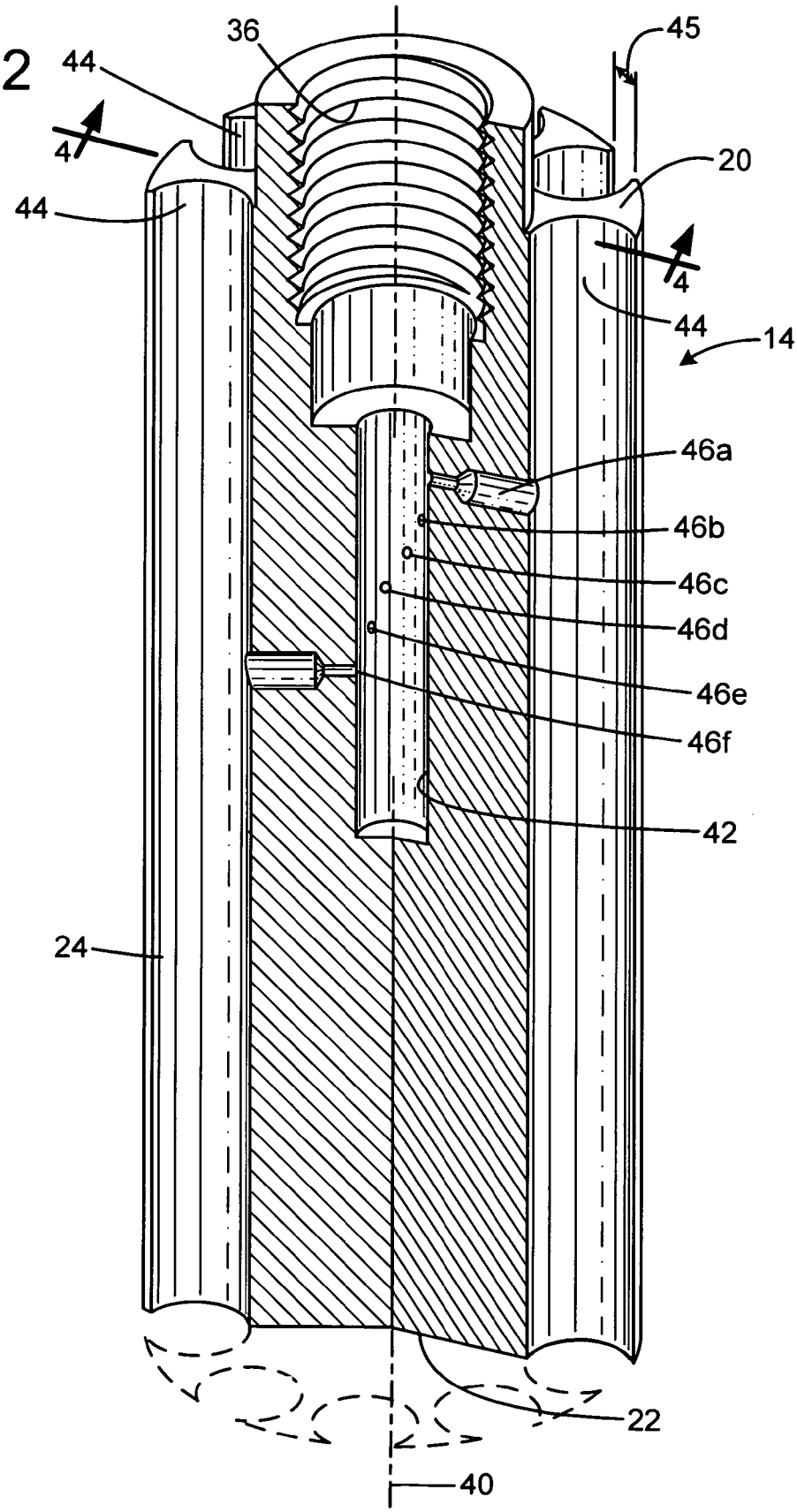
FIG. 2 is a sectional view of a device body according to the preferred embodiment.

FIG. 2 shows the frame 14 in a cut-away view. The frame is a straight cylindrical body formed of a monolithic unitary block of material. In the preferred embodiment, it is formed as an aluminum extrusion, with the source extrusion including all the features that run the entire length of the frame, and with the other features being formed by post-machining. In the description, its form may be described in terms of machining steps to produce it from bar stock as opposed to extrusion, in order to explain the structure more clearly. In alternative embodiments, the frame may be made from any rigid, durable, heat and fire resistant material such as certain ceramics, plastics, resins, and a wide variety of metals.

The frame essentially defines the finished dimensions of the device. It is sized to be handheld, with a diameter that provides for a secure grip. A diameter of 1.0-4.0 inch may be considered suitable for certain applications, while a diameter of 1.25-2.0 inch is preferred. The frame length is sized to provide an adequate grip and to ensure that the end faces are exposed when gripped by someone with large hands. A length of at least 3 inch is needed, and at least about 3.75 inch is preferred.

The frame has a central bore sharing the axis 40 of the frame having an internally threaded entrance 36 at the top surface 20. The threaded entrance is configured to receive the fuse device 26. The bore continues into the frame to a partial depth with a delay column chamber bore 42. The bore is a blind hole that does not penetrate the bottom surface of the frame. However, in alternative embodiments, the bore may pass fully through (such as if extruded) and then plugged by any conventional means.

The frame defines nine evenly spaced cylindrical channels 44 about the perimeter of the cylindrical sidewall 24. The channels are bores defined just beneath the surface of the frame, with a linear gap 45 opening each channel up along the length of the frame. The channels run parallel to each other and to the axis 40 and are spaced with rotational symmetry about the axis. In alternative embodiments, any number of channels may be provided.

Preferably, the frame diameter and channel diameters and quantities are selected to provide an efficient use of space while maintaining adequate structural strength between the channels. In the preferred embodiment, the frame has a diameter of 1.463 inch, and the channels are bores of 0.313 inch diameter centered on a circle having a diameter of 1.150 inch. Thus, if the channels were simply bored, there would be a thin wall of 0.078 inch thick at its thinnest point beneath the surface 24. However, each channel is open to the exterior along its length to form the gap 45. This is 0.188 inch in the preferred embodiment, and provides a distinct appearance, graspable texture, and visual confirmation of the assembly.

The frame includes nine ignition passages 46*a-i*, one for each channel. Each passage is drilled on a line perpendicular to the axis 40 and intersects both the axis and the axis of the channel with which it communicates. Each passage has an inner portion with a diameter of 0.078 inch and an outer portion closer to the channel with a diameter of 0.125. The channel gap 45 of 0.188 inch is wide enough to accommodate the 0.125 diameter tool for this operation.

In the preferred embodiment the passages are at different locations along the length of the column 42. This provides a timed sequence of activating flash charges in each channel, as will be discussed below. In the preferred embodiment, the passages are separated axially from adjacent passages by 0.125 inch, so that the entire sequence of passages takes 1.0 inches of the length. This can vary widely depending on the application, with the spacing being irregular to provide more random sounding bangs. Or, they may be positioned at the same or nearly the same position, so that a simultaneous or simultaneous sounding report is heard. In the preferred embodiment the passages open up into the column in a helical pattern.

Figure 3:
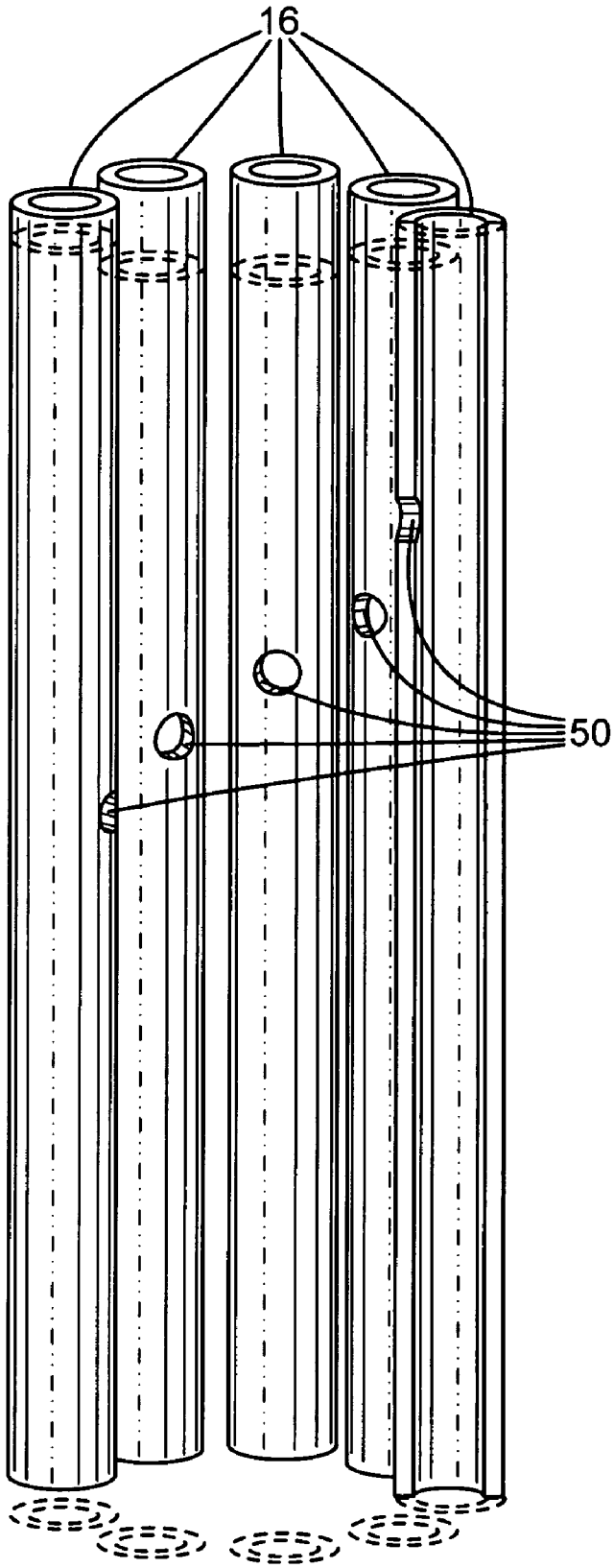
FIG. 3 is a perspective view of sleeve inserts according to the preferred embodiment.

FIG. 3 shows a representative group of the nine sleeves 16. The sleeves serve as containers for the flash charge material and are elongated cylindrical tubes of common dimension. They have a diameter of 0.3125 inch to provide a secure press-fit in the frame channels. They have a length to match that of the frame, so they extend from the top end face to the bottom end face, approximately flush. The interior bores have a diameter of 0.242 inch, for a wall thickness of 0.035 inch. In the preferred embodiment, the sleeves are formed of a high-strength material, such as carbon steel or stainless steel, to adequately contain the pressures from discharge of the flash charge in each sleeve. Stainless steel is preferred because of its greater ductility, which resists fragmentation upon failure, and permits a thinner wall and therefore an advantageously lighter sleeve.

Each sleeve is identical to the others, except for a lateral sleeve aperture 50 in each sleeve is positioned at a position on the sleeve's length to register with the aperture 46 of the channel 44 it will reside in. The aperture 50 has a diameter of 0.052 inch, which is smaller than the passage at the channel, and tolerates minor misalignment axially or rotationally. Each sleeve may be provided with some visual indicia or mechanical keying to ensure proper alignment and that the sleeves are in the proper channels.

The sleeves are open on the ends to provide that the only escape of gases and materials upon discharge is via them being expelled axially. The provision of equal openings at both ends means that the motive forces generated by expelled gases will be balanced, so that the device tends to remain stationary where it was discharged instead of moving unpredictably as the sleeves sequentially discharge. The aperture 50 is much smaller than these end openings, and opens into an enclosed space, so that any small jet of gases is resisted and contained. The sides of the steel sleeves facing outward toward the user's grip hand are solid and unbroken, providing a safe barrier against injury even if the device were discharged in the user's hand.

Figure 4:
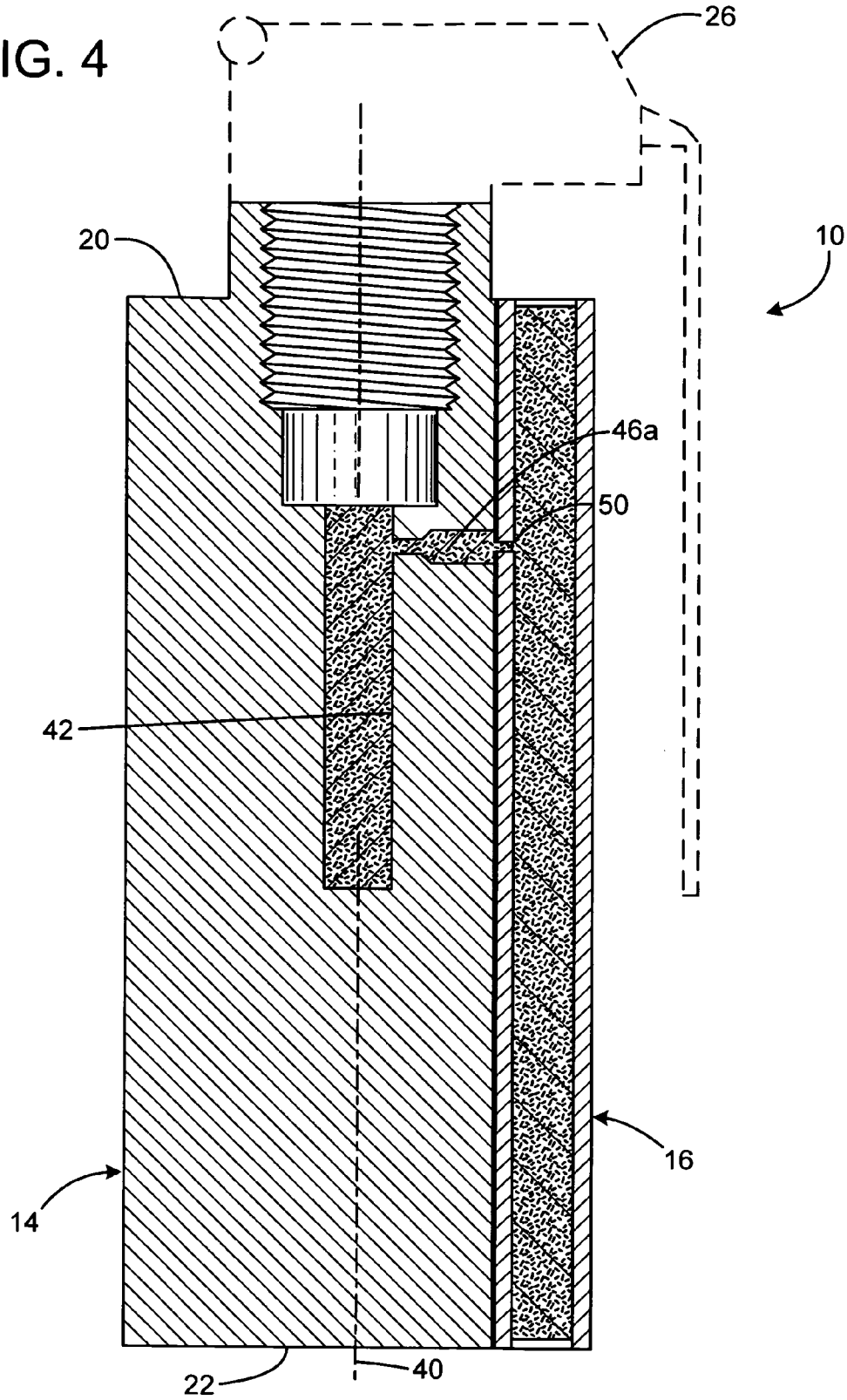
FIG. 4 is a sectional view of the device according the preferred embodiment taken along line 4-4 of FIG. 2.

FIG. 4 shows the assembled device 10. Assembly occurs first by pressing the sleeves into the channels. Then, the sleeves are filled with the flash charge material and capped at both ends. The delay column 42 is filled with the delay material such as black powder. The lateral apertures do not need to be fully filled with either material, as the dust and particles that enter the apertures are adequate to sustain the flame from the delay column to the sleeved flash charge material. A fuse assembly is screwed onto the body, and the device is ready for deployment.

Figure 5:
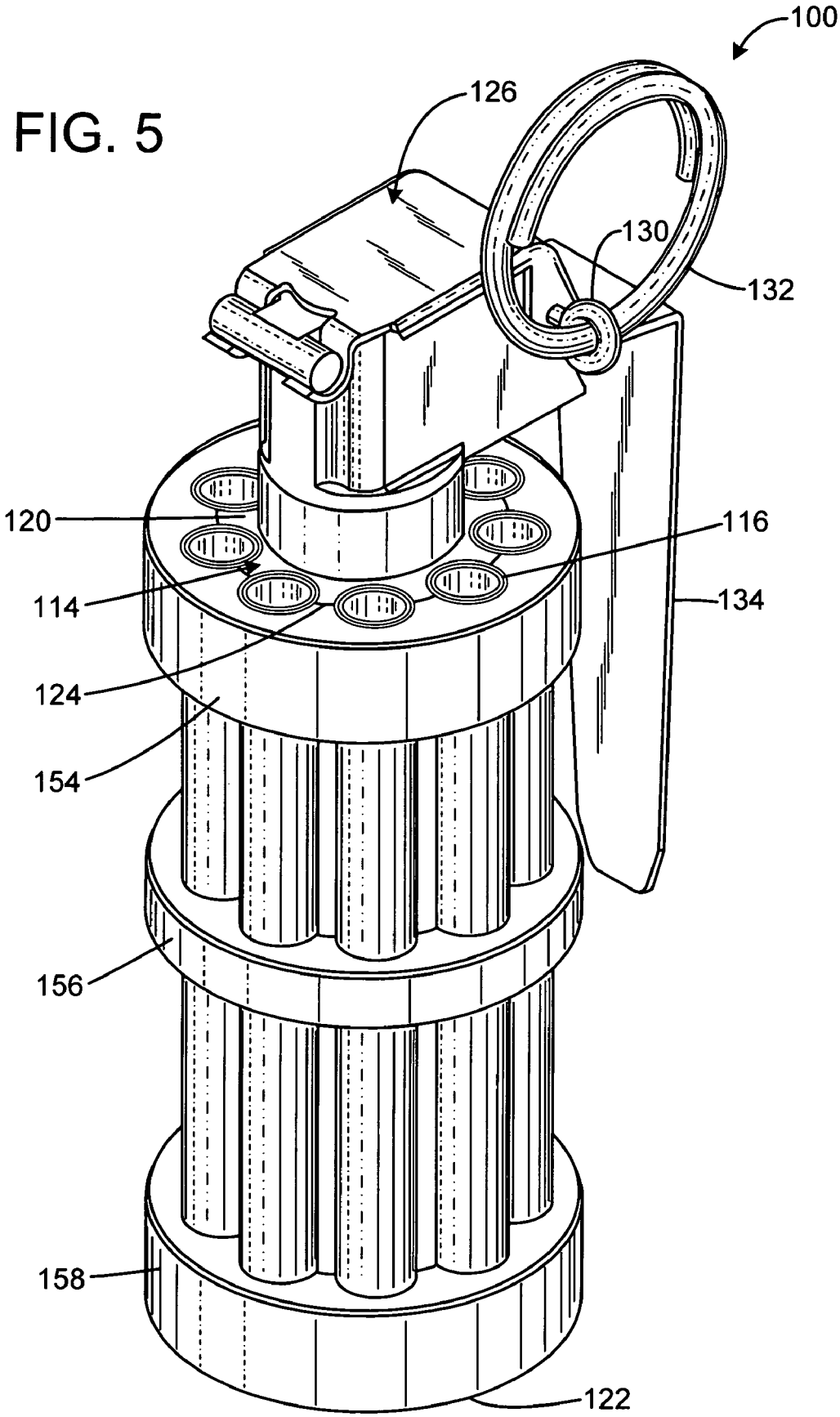
FIG. 5 is a perspective view of a device according to an alternative embodiment of the invention.

FIG. 5 shows a flash-bang pyrotechnic device 100 having a cylindrical body 112 formed of a cylindrical frame 114 holding nine sleeves 116. The body has a top end face 120, a bottom end face 122, and a cylindrical sidewall 124. A fuse assembly 126 protrudes from the center of the top end face and includes a safety pin 130 with connected extraction ring 132 and a spring-loaded paddle 134 that initiates a discharge sequence when the paddle is released after the safety pin is removed. An upper retainer ring 154, middle retainer ring 156, and lower retainer ring 158 encircle the frame and sleeves. The upper retainer ring 154 is positioned approximately flush against the body's top end face 120, the middle retainer ring 156 is positioned approximately at the middle of the body, and the lower retainer ring 158 is positioned approximately flush against the body's bottom end face 122. The retainer rings laterally restrain the sleeves against the frame. Multiple retainer rings are used because they provide significant weight savings compared to a single continuous retainer sleeve.

Figure 6:
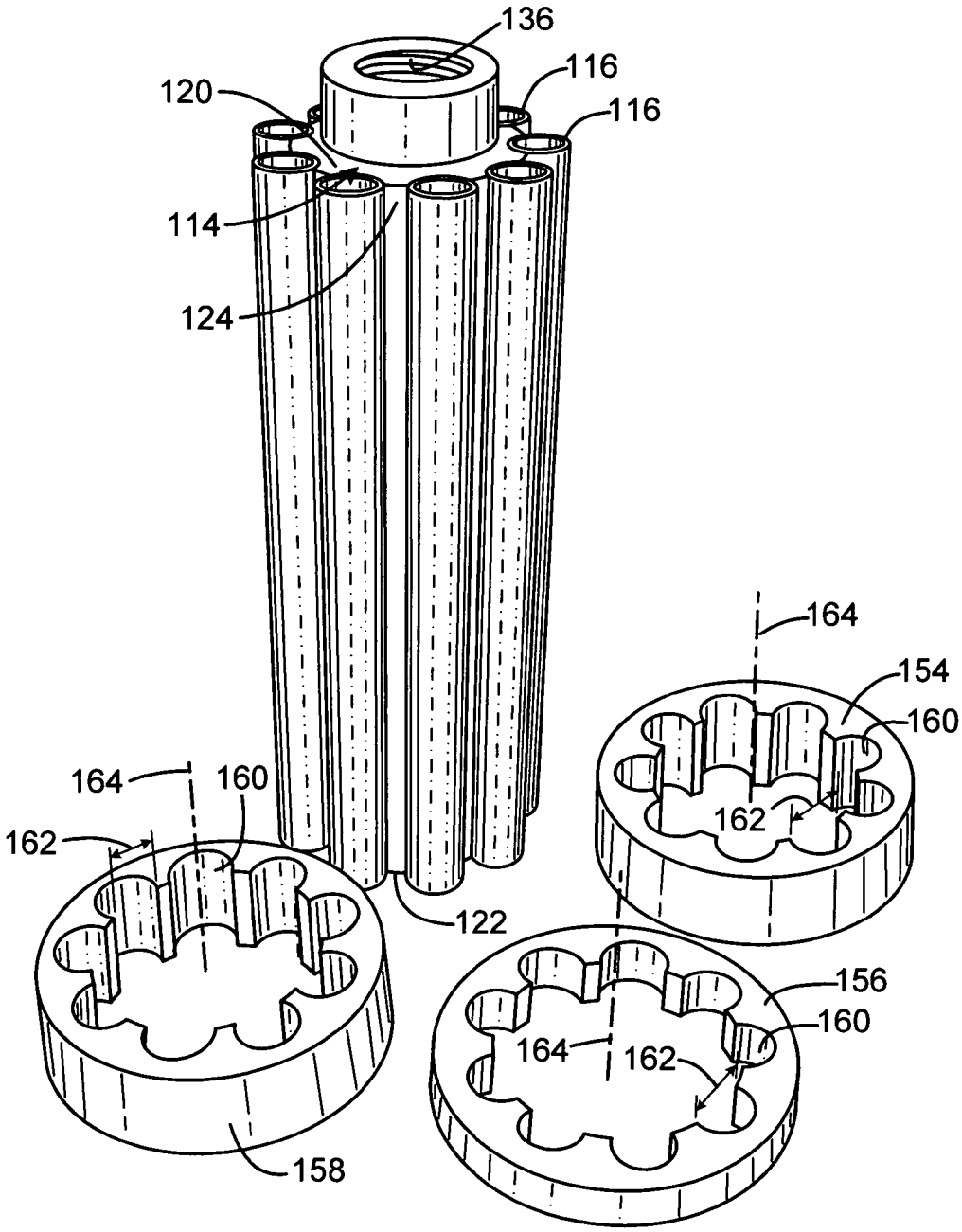
FIG. 6 is a perspective view of a device body according to the alternative embodiment.

FIG. 6 shows the frame 114 with the retainer rings 154, 156, and 158 removed. The frame is a straight cylindrical body formed of a monolithic unitary block of material. In the preferred embodiment, it is formed as an aluminum extrusion, with the source extrusion including all the features that run the entire length of the frame, and with the other features being formed by post-machining. In the description, its form may be described in terms of machining steps to produce it from bar stock as opposed to extrusion, in order to explain the structure more clearly. In alternative embodiments, the frame may be made from any rigid, durable, heat and fire resistant material such as certain ceramics, plastics, resins, and a wide variety of metals.

The frame essentially defines the finished dimensions of the device. It is sized to be handheld, with a diameter that provides for a secure grip. A diameter of 1.0-4.0 inch may be considered suitable for certain applications, while a diameter of 1.25-2.0 inch is preferred. The frame length is sized to provide an adequate grip, and to ensure that the end faces are exposed when gripped by someone with large hands. A length of at least 3 inch is needed, and at least about 3.75 inch is preferred.

The frame has a central bore sharing the axis 140 of the frame having an internally threaded entrance 136 at the top surface 120. The threaded entrance is configured to receive the fuse device 126. The bore continues into the frame to a partial depth with a delay column chamber bore 142. The bore is a blind hole that does not penetrate the bottom surface of the frame. However, in alternative embodiments, the bore may pass fully through (such as if extruded) and then plugged by any conventional means.

The frame defines nine evenly spaced cylindrical channels 144 about the perimeter of the cylindrical sidewall 124. The channels are bores defined just beneath the surface of the frame, with a linear gap 145 opening each channel up along the length of the frame. The channels run parallel to each other and to the axis 140 and are spaced with rotational symmetry about the axis. The channels do not laterally restrain the sleeves, so the sleeves can be inserted into the channels from the side. This is accomplished by the channels surrounding the sleeves less than 180°. In alternative embodiments, any number of channels may be provided.

Preferably, the frame diameter and channel diameters and quantities are selected to provide an efficient use of space while maintaining adequate structural strength between the channels. In the preferred embodiment, the frame has a diameter of 1.463 inch, and the channels are bores of 0.313 inch diameter, centered on a circle having a diameter of 1.150 inch. Thus, if the channels were simply bored, there would be a thin wall of 0.078 inch thick at its thinnest point beneath the surface 24. However, each channel is open to the exterior along its length to form the gap 45. This is 0.188 inch in the preferred embodiment, and provides a distinct appearance, graspable texture, and visual confirmation of the assembly.

Each retainer ring defines nine evenly spaced cylindrical channels 160 about their inner perimeter. The channels are bores defined just beneath the inner surface of the retainer rings, with a linear gap 162 opening each channel up along the width of the retainer rings. The channels run parallel to each other and to the axis 164 and are spaced with rotational symmetry about the axis. In alternative embodiments, any number of channels may be provided.

Preferably, the retainer rings' diameters and channel diameters and quantities are selected to provide a tight fit around the frame and sleeves to prevent lateral movement of the sleeves. In the preferred embodiment, the retainer rings have a diameter of 1.750 inch, and the channels are bores of 0.313 inch diameter, centered on a circle having a diameter of 1.150 inch. Thus, if the channels were simply bored, there would be a thin wall of 0.143 inch thick at its thinnest point. However, each channel is open to the exterior along its length to form the gap 162. This is 0.313 inch in the preferred embodiment. The upper retainer ring 154 and lower retainer ring 158 are wider than the middle retainer ring 156. The upper retainer ring 154 and lower retainer ring 158 have a width of 0.500 inch in the preferred embodiment. The middle retainer ring 156 has a width of 0.300 inch in the preferred embodiment.

Figure 7:
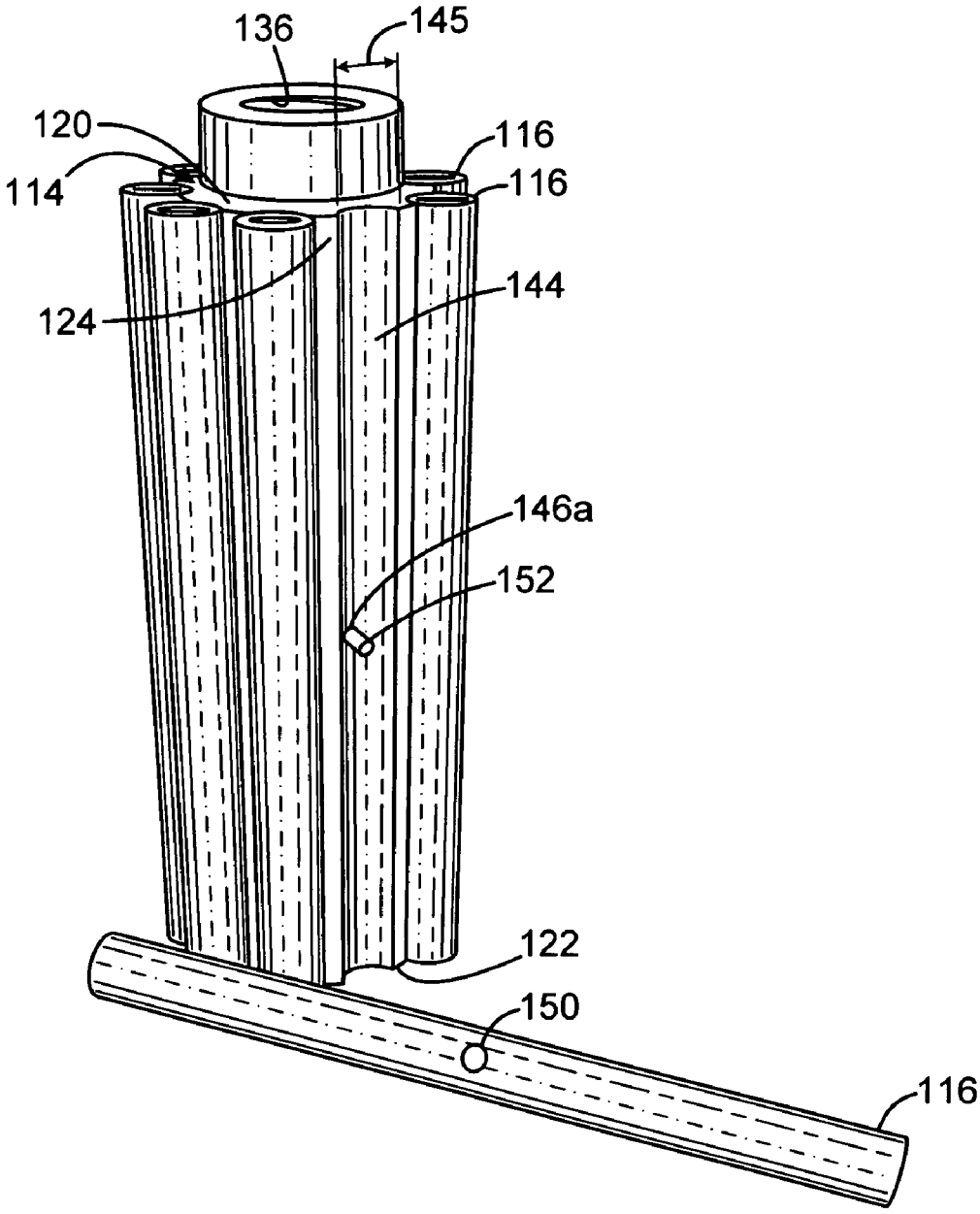
FIG. 7 is a perspective view of the device body according to the alternative embodiment.

FIG. 7 shows the frame 114 with both the retainer rings 154, 156, and 158 and one of the nine sleeves 116 removed. The frame includes nine ignition passages 146*a-i*, one for each channel in the frame. Each passage is drilled on a line perpendicular to the axis 140 and intersects both the axis and the axis of the channel with which it communicates. Each passage has an inner portion with a diameter of 0.078 inch, and an outer portion closer to the channel with a diameter of 0.125. The channel gap 145 of 0.313 inch is wide enough to accommodate the 0.125 diameter tool for this operation. There are nine alignment tubes 152, with each passage receiving one end of one of the alignment tubes.

The sleeves serve as containers for the flash charge material, and are elongated cylindrical tubes of common dimension. They have a diameter of 0.313 inch to provide a close fit in the frame channels. They have a length to match that of the frame, so they extend from the top end face to the bottom end face, approximately flush. The interior bores have a diameter of 0.243 inch, for a wall thickness of 0.035 inch. In the preferred embodiment, the sleeves are formed of a high-strength material, such as carbon steel or stainless steel, to adequately contain the pressures from discharge of the flash charge in each sleeve. Stainless steel is preferred because of its greater ductility, which resists fragmentation upon failure, and permits a thinner wall and therefore an advantageously lighter sleeve.

Each sleeve is identical to the others, except for a lateral sleeve aperture 150 in each sleeve is positioned at a location on the sleeve's length to register with the passage 146 of the channel 144 it will reside in. The aperture 150 receives the protruding end of the alignment tube 152 in the channel 144 the sleeve resides in. The aperture 150 has a diameter of 0.063 inch, which is larger than the outer diameter of the alignment tube in the channel, and tolerates minor misalignment axially or rotationally. The alignment tubes ensure each sleeve is properly aligned and in the proper channel.

Figure 8:
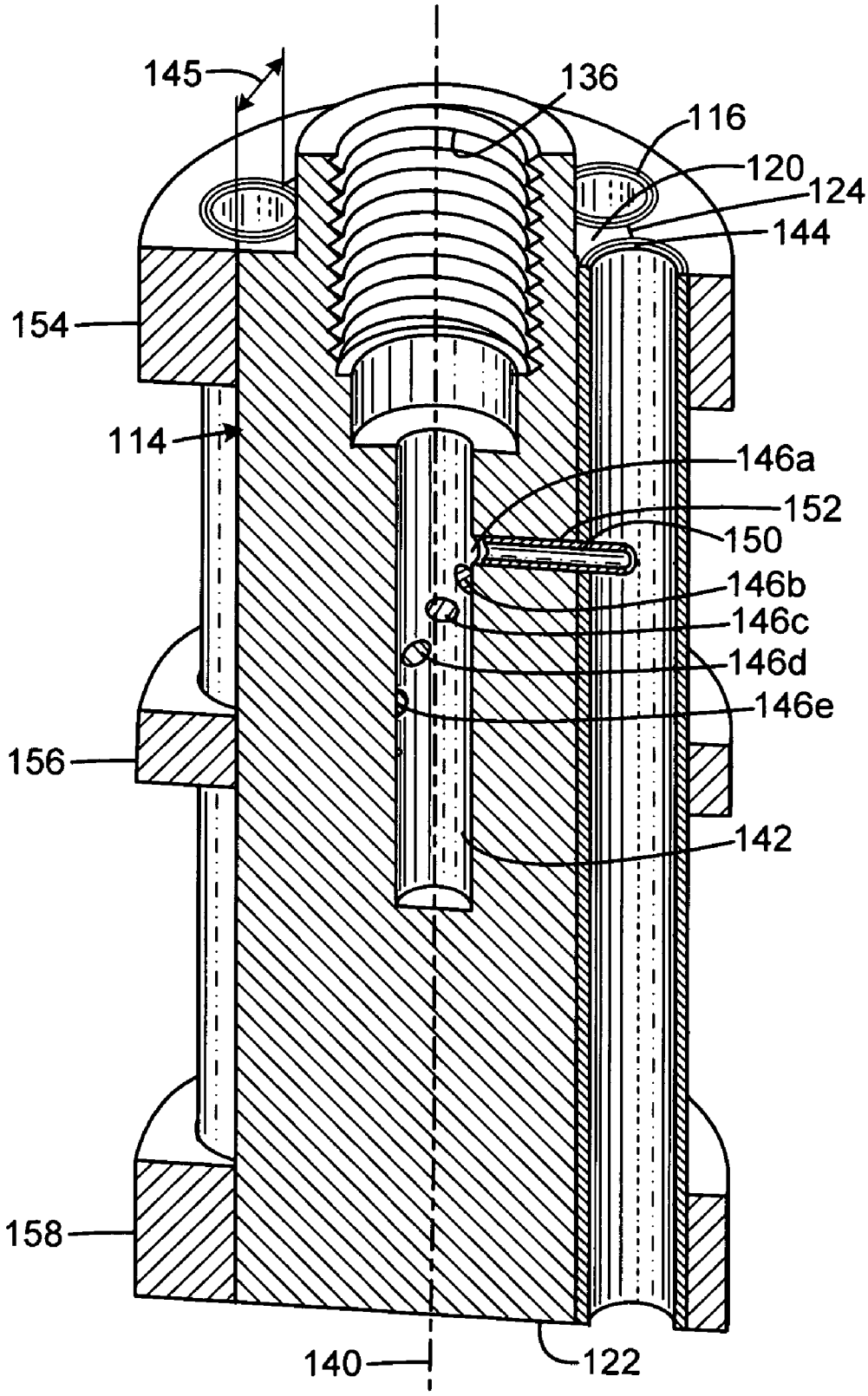
FIG. 8 is a sectional view of the device according the preferred embodiment taken along line 8-8 of FIG. 5.

FIG. 8 shows the shows the frame 114, sleeves 116, and retainer rings 154, 156, and 158 in a cut-away view. In the preferred embodiment, the ignition passages 146 are at different locations along the length of the column 142. This provides a timed sequence of activating flash charges in each channel, as will be discussed below. In the preferred embodiment, the passages are separated axially from adjacent passages by 0.125 inch, so that the entire sequence of passages takes 1.0 inches of the length. This can vary widely depending on the application, with the spacing being irregular to provide more random sounding bangs. Or, they may be positioned at the same or nearly the same position, so that a simultaneous or simultaneous sounding report is heard. In the preferred embodiment the passages open up into the column in a helical pattern.

The sleeves are open on the ends to provide that the only escape of gases and materials upon discharge is via them being expelled axially. The provision of equal openings at both ends means that the motive forces generated by expelled gases will be balanced, so that the device tends to remain stationary where it was discharged instead of moving unpredictably as the sleeves sequentially discharge. The aperture 150 is much smaller than these end openings, and opens into an enclosed space, so that any small jet of gases is resisted and contained. The sides of the steel sleeves facing outward toward the user's grip hand are solid and unbroken, providing a safe barrier against injury even if the device were discharged in the user's hand.

Assembly occurs by first extruding or machining the frame to define the nine channels and the central bore. Subsequently, the lateral passages are drilled in the frame at different elevations to provide communication between the channels and the central bore. Nine tubular sleeves are obtained, and each sleeve has a lateral aperture drilled in its sidewall at a different position along its length. Each of the lateral apertures is drilled at the same elevation as one of the lateral passages. Then, each of the lateral passages receives one end of an alignment tube. The sleeves are then laterally pressed into the channels, with the protruding end of the alignment tubes being received by the apertures in the sleeves. Subsequently, the retainer rings are slid over the sleeves. Then, the sleeves are filled with the flash charge material and capped at both ends. The delay column 142 is filled with the delay material such as black powder. The lateral passages and alignment tubes do not need to be fully filled with either material, as the dust and particles that enter the apertures are adequate to sustain the flame from the delay column to the sleeved flash charge material. Finally, a fuse assembly is screwed onto the frame, and the device is ready for deployment.

While the above is discussed in terms of preferred and alternative embodiments, the invention is not intended to be so limited. For instance, the operational safety benefits of the invention may be obtained in a monolithic steel device that does employ the sleeve features. This would be drilled through to provide similarly positioned flash-charge bores, and bored for the central column. The apertures must be drilled through from the cylindrical sidewall. These access holes then must be enclosed, such as by spot welding, or by a sleeve encasing the body.

The invention claimed is:

1. A stun grenade device comprising:

an elongated body defining a body axis and having a sidewall and opposed top and bottom end faces;

the body including a delay chamber containing a delay material;

the body having a plurality of flash charge chambers each containing a quantity of flash charge material;

the body defining a plurality of ignition passages, each ignition passage communicating from a respective flash charge chamber to the delay chamber, each flash charge chamber having at least one exhaust aperture;

each of the exhaust apertures penetrating at least one of the top and bottom end faces; and wherein the body includes a frame defining a plurality of sleeve chambers, and including a sleeve insert in each sleeve chamber, each sleeve insert defining a flash charge chamber, wherein each sleeve chamber is open along its entire length via an elongated opening in the sidewall of the frame.

2. The device of claim 1 wherein each of the flash charge chambers has a first exhaust aperture penetrating the top end face, and a second exhaust aperture penetrating the bottom end face.

3. The device of claim 1 wherein each of the flash charge chambers is an elongated bore parallel to the body axis.

4. The device of claim 1 wherein the flash charge chambers are arranged in a cylindrical array.

5. The device of claim 1 wherein each of the flash charge chambers is positioned adjacent to and just below the sidewall.

6. The device of claim 1 wherein the delay chamber is an elongated bore extending to a fuse at the top end face and providing a delay column, the delay column being centered on the body axis.

7. The device of claim 1 wherein at least some of the ignition passages are located at different positions with respect to the delay chamber, such that a flame front in the delay chamber reaches some of the passages at different times.

8. The device of claim 1 wherein the ignition passages are bores perpendicular to the body axis.

9. The device of claim 1 wherein the body is cylindrical.

10. The device of claim 1 further comprising a plurality of alignment tubes having opposing ends wherein each of the ignition passages receives one end of one of the alignment tubes and each of the flash charge chambers receives the opposing end of one of the alignment tubes.

11. The device of claim 1 wherein the sleeve inserts are formed of a different material than the frame.

12. The device of claim 1 wherein the sleeve inserts are formed of a stronger material than the frame.

13. The device of claim 1 wherein the frame is formed of a lighter material than the sleeve inserts.

14. The device of claim 1 wherein the frame is formed of aluminum and the sleeve inserts are formed of steel.

15. The device of claim 1 wherein each sleeve insert defines a single lateral sleeve aperture at a selected position along its length, and registered with a corresponding ignition passage in the body.

16. The device of claim 15 further comprising a plurality of alignment tubes having opposing ends wherein each of the ignition passages receives one end of one of the alignment tubes and each of the lateral sleeve apertures receives the opposing end of one of the alignment tubes.

17. The device of claim 15 wherein the position of each sleeve aperture along the length of each sleeve insert is different from the position of the sleeve apertures on the other sleeve inserts.

18. The device of claim 1 wherein a portion of each sleeve insert is exposed along the entire length of the sleeve insert.

19. The device of claim 1 wherein each sleeve insert is a straight cylindrical tube defining a concentric bore.

20. The device of claim 1 wherein each sleeve insert extends the length of the frame.

21. The device of claim 1 wherein the sidewall is free of penetrations communicating with any of the flash-charge chambers.

22. A stun grenade device comprising:

an elongated body defining a body axis and having a sidewall and opposed top and bottom end faces;

the body including a delay chamber containing a delay material;

the body having a plurality of flash charge chambers each containing a quantity of flash charge material;

the body defining a plurality of ignition passages, each ignition passage communicating from a respective flash charge chamber to the delay chamber;

each flash charge chamber having at least one exhaust aperture;

each of the exhaust apertures penetrating at least one of the top and bottom end faces; and wherein the body includes a frame defining a plurality of sleeve chambers, and including a sleeve insert in each sleeve chamber, each sleeve insert defining a flash charge chamber, wherein a portion of each sleeve insert is exposed along the entire length of each sleeve insert.

23. The device of claim 22 wherein each of the flash charge chambers has a first exhaust aperture penetrating the top end face, and a second exhaust aperture penetrating the bottom end face.

24. The device of claim 22 wherein each of the flash charge chambers is an elongated bore parallel to the body axis.

25. The device of claim 22 wherein the flash charge chambers are arranged in a cylindrical array.

26. The device of claim 22 wherein each of the flash charge chambers is positioned adjacent to and just below the sidewall.

27. The device of claim 22 wherein the delay chamber is an elongated bore extending to a fuse at the top end face and providing a delay column, the delay column being centered on the body axis.

28. The device of claim 22 wherein at least some of the ignition passages are located at different positions with respect to the delay chamber, such that a flame front in the delay chamber reaches some of the passages at different times.

29. The device of claim 22 wherein the ignition passages are bores perpendicular to the body axis.

30. The device of claim 22 wherein the body is cylindrical.

31. The device of claim 22 further comprising a plurality of alignment tubes having opposing ends wherein each of the ignition passages receives one end of one of the alignment tubes and each of the flash charge chambers receives the opposing end of one of the alignment tubes.

32. The device of claim 22 wherein the sleeve inserts are formed of a different material than the frame.

33. The device of claim 22 wherein the sleeve inserts are formed of a stronger material than the frame.

34. The device of claim 22 wherein the frame is formed of a lighter material than the sleeve inserts.

35. The device of claim 22 wherein the frame is formed of aluminum and the sleeve inserts are formed of steel.

36. The device of claim 22 wherein each sleeve insert defines a single lateral sleeve aperture at a selected position along its length, and registered with a corresponding ignition passage in the body.

37. The device of claim 36 further comprising a plurality of alignment tubes having opposing ends wherein each of the ignition passages receives one end of one of the alignment tubes and each of the lateral sleeve apertures receives the opposing end of one of the alignment tubes.

38. The device of claim 36 wherein the position of each sleeve aperture along the length of each sleeve insert is different from the position of the sleeve apertures on the other sleeve inserts.

39. The device of claim 22 wherein each sleeve chamber is open along its entire length via an elongated opening in the sidewall of the frame.

40. The device of claim 22 wherein each sleeve insert is a straight cylindrical tube defining a concentric bore.

41. The device of claim 22 wherein each sleeve insert extends the length of the frame.

42. The device of claim 22 wherein the sidewall is free of penetrations communicating with any of the flash-charge chambers.

* * * * *

UNITED STATES PATENT AND TRADEMARK OFFICE

CERTIFICATE OF CORRECTION

PATENT NO. : 7,963,227 B1
APPLICATION NO. : 12/319236
DATED : June 21, 2011
INVENTOR(S) : Michael Brunn It is certified that error appears in the above-identified patent and that said Letters Patent is hereby corrected as shown below:

On the Title Page, Item (73) Assignee "CombMed Systems, Inc., Great Neck, NY (US)" should read --Combined Systems, Inc., Great Neck, NY (US)--.

Signed and Sealed this
Thirteenth Day of September, 2011

David J. Kappos

David J. Kappos
*Director of the United States Patent and Trademark Office*